US012484720B1

(12) United States Patent
Hayton

(10) Patent No.: US 12,484,720 B1
(45) Date of Patent: Dec. 2, 2025

(54) PILLOW WITH ENHANCED COMFORT

(71) Applicant: Ali Hayton, Mount Vernon, WA (US)

(72) Inventor: Ali Hayton, Mount Vernon, WA (US)

( * ) Notice: Subject to any disclaimer, the term of this patent is extended or adjusted under 35 U.S.C. 154(b) by 88 days.

(21) Appl. No.: 18/539,919

(22) Filed: Dec. 14, 2023

Related U.S. Application Data

(60) Provisional application No. 63/432,408, filed on Dec. 14, 2022.

(51) Int. Cl.
*A47G 9/10* (2006.01)

(52) U.S. Cl.
CPC .... *A47G 9/1036* (2013.01); *A47G 2009/1018* (2013.01)

(58) Field of Classification Search
CPC ..... A47G 9/1036; A47G 2009/1018; A47G 9/10; A47G 2200/16; A47G 2200/163; A47G 2200/166
See application file for complete search history.

(56) References Cited

U.S. PATENT DOCUMENTS 2,750,606 A * 6/1956 Freedlander ..... A47G 9/10 5/636
3,928,876 A * 12/1975 Starr ..... A47C 21/044 5/284
4,325,151 A * 4/1982 Wu ..... A47G 9/1036 5/636
5,632,051 A 5/1997 Stanley et al.
6,516,624 B1 * 2/2003 Ichigaya ..... A41D 13/0056 62/259.3
6,668,407 B1 * 12/2003 Reitzel ..... A47C 1/143 5/639
D656,356 S 3/2012 Cheng
8,316,649 B2 * 11/2012 Wolske ..... A61F 7/08 62/3.5
8,468,628 B1 * 6/2013 Cheng ..... A47G 9/1054 5/652.2
10,063,952 B2 * 8/2018 Fuchs ..... A47G 9/1045
10,201,236 B1 * 2/2019 Cloud ..... A47G 9/1045
11,331,214 B2 5/2022 Baker et al.
(Continued)

FOREIGN PATENT DOCUMENTS

CN 112401601 A * 2/2021
CN 119138738 A * 12/2024
KR 20240056934 A * 5/2024

*Primary Examiner* — David E Sosnowski
(74) *Attorney, Agent, or Firm* — Cramer Patent & Design, PLLC.; Aaron R. Cramer

(57) ABSTRACT

The device presents a cooling pillow designed to improve sleep comfort by delivering a controlled cooling effect. It features an ergonomically contoured top section for supporting the user's head, neck, and upper body. The pillow integrates a conduit system with two electric blowers, generating a forced air flow for cooling. Adjustable louvers and a front vent regulate and direct this air flow. The cooling mechanism operates on a rechargeable power system, encompassing a battery, charge controller, and a variable-speed power switch. A main controller and wireless transceiver facilitate remote operation adjustments. Constructed from memory foam and enclosed in a satin cover, the pillow also includes an internal compartment for easy maintenance. This cooling pillow offers enhanced sleep comfort, particularly beneficial for individuals experiencing increased body temperature at night.

2 Claims, 6 Drawing Sheets

(56) References Cited

U.S. PATENT DOCUMENTS

| | | | | |
|---|---|---|---|---|
| 2012/0131747 | A1* | 5/2012 | Sclare | A61F 7/02 362/127 |
| 2012/0142999 | A1* | 6/2012 | Albu | A47G 9/1036 5/636 |
| 2015/0025606 | A1* | 1/2015 | Davis | A47G 9/1036 607/104 |
| 2016/0066716 | A1* | 3/2016 | Rao | A61B 5/6814 600/26 |
| 2016/0309929 | A1* | 10/2016 | Bowen | A47G 9/1036 |
| 2016/0338514 | A1* | 11/2016 | Chan | A47G 9/10 |
| 2018/0063612 | A1* | 3/2018 | Fuchs | A47G 9/1045 |
| 2018/0146807 | A1* | 5/2018 | Silver | A47G 9/1009 |
| 2018/0317677 | A1* | 11/2018 | Genao | A47G 9/1045 |
| 2022/0007862 | A1* | 1/2022 | King | A47G 9/0253 |
| 2023/0118357 | A1* | 4/2023 | Milne | A47G 9/1045 5/639 |
| 2023/0255372 | A1* | 8/2023 | Maniaci | A47G 9/1081 5/640 |
| 2024/0277166 | A1* | 8/2024 | Thompson | A47G 9/1036 |
| 2025/0098880 | A1* | 3/2025 | Lunzer | A47G 9/1036 |

* cited by examiner

PILLOW WITH ENHANCED COMFORT

RELATED APPLICATIONS

The present device was first described in and is a continuation of U.S. Provisional Application No. 63/432,408, filed Dec. 14, 2022, the entire disclosures of which are incorporated herein by reference.

FIELD OF THE DEVICE

The present device relates to a pillow that provides enhanced comfort when resting thereon.

BACKGROUND OF THE DEVICE

Sleep is a critical aspect of human life, with approximately one-third of our lifetime spent in its grasp. This significant portion underscores the importance of comfort during sleep. A primary element of this comfort is often found in the quality of one's pillow. A cool pillow is not just a comfort item but a necessity for many, especially for those experiencing menopausal symptoms or hormonal-induced nighttime sweating.

The standard approach to maintaining a cool pillow involves flipping it during the night. However, this action can disrupt sleep, making it challenging to return to a restful state. This issue points to a clear need for a solution that provides consistent coolness throughout the night without the need to flip the pillow.

The ideal solution is a pillow designed with advanced comfort features. Such a pillow would consistently maintain a cool surface, thereby enhancing the quality of sleep. This innovation would be particularly beneficial for those who experience discomfort due to increased body temperature at night. A pillow designed to remain cool throughout the night would not only cater to the need for uninterrupted sleep but also be durable enough for regular use. The goal of the present device is to provide a solution that offers a better, more restful sleep through a reliably cool pillow surface.

SUMMARY OF THE DEVICE

The present disclosure relates to a pillow designed to provide a cooling effect, enhancing the comfort of users during sleep. The pillow features a contoured top section, ergonomically designed to support the head, neck, and upper body. Integrated within the pillow is a conduit system extending between the first and second sides.

This system includes two blowers, electrically connected to a power supply and charge controller, engineered to produce a forced air flow through the conduit. Adjustable louvers at the ends of the conduit allow regulation of air flow. Additionally, a front vent, aligned with the conduit, is designed to direct this air flow towards the user.

The pillow incorporates a rechargeable power system, including a charging port and a power switch with variable speed control for the blowers. An intelligent control system comprises a main controller, capable of sending variable output signals to a motor drive controller for precise blower operation, and a wireless transceiver for remote operation. The pillow's construction involves memory foam with a protective satin cover, contributing to both comfort and durability.

Further features include strategically placed creases in the contoured section to mimic the natural curvature of the human body. The adjustable louvers can be configured to control the intensity and direction of the air flow. A built-in battery system ensures uninterrupted operation. The vent may be covered with a thermally conductive mesh material for effective heat dissipation. An accessible internal compartment allows for maintenance or modification, sealed with a secure fastener.

Compatibility with a range of personal electronic devices via the transceiver allows for user-specific customization of settings like blower speed and timer functions. The inclusion of a single-board computer as the main controller provides advanced functionality, handling complex input and output signals. Each blower is a compact electric fan, designed for efficient air movement with minimal noise. The power switch's variable speed adjustment feature enables personalization of the cooling effect to the user's preference.

BRIEF DESCRIPTION OF THE DRAWINGS

The advantages and features of the present device will become better understood with reference to the following more detailed description and claims taken in conjunction with the accompanying drawings, in which like elements are identified with like symbols, and in which:

DESCRIPTIVE KEY

Figure 1:
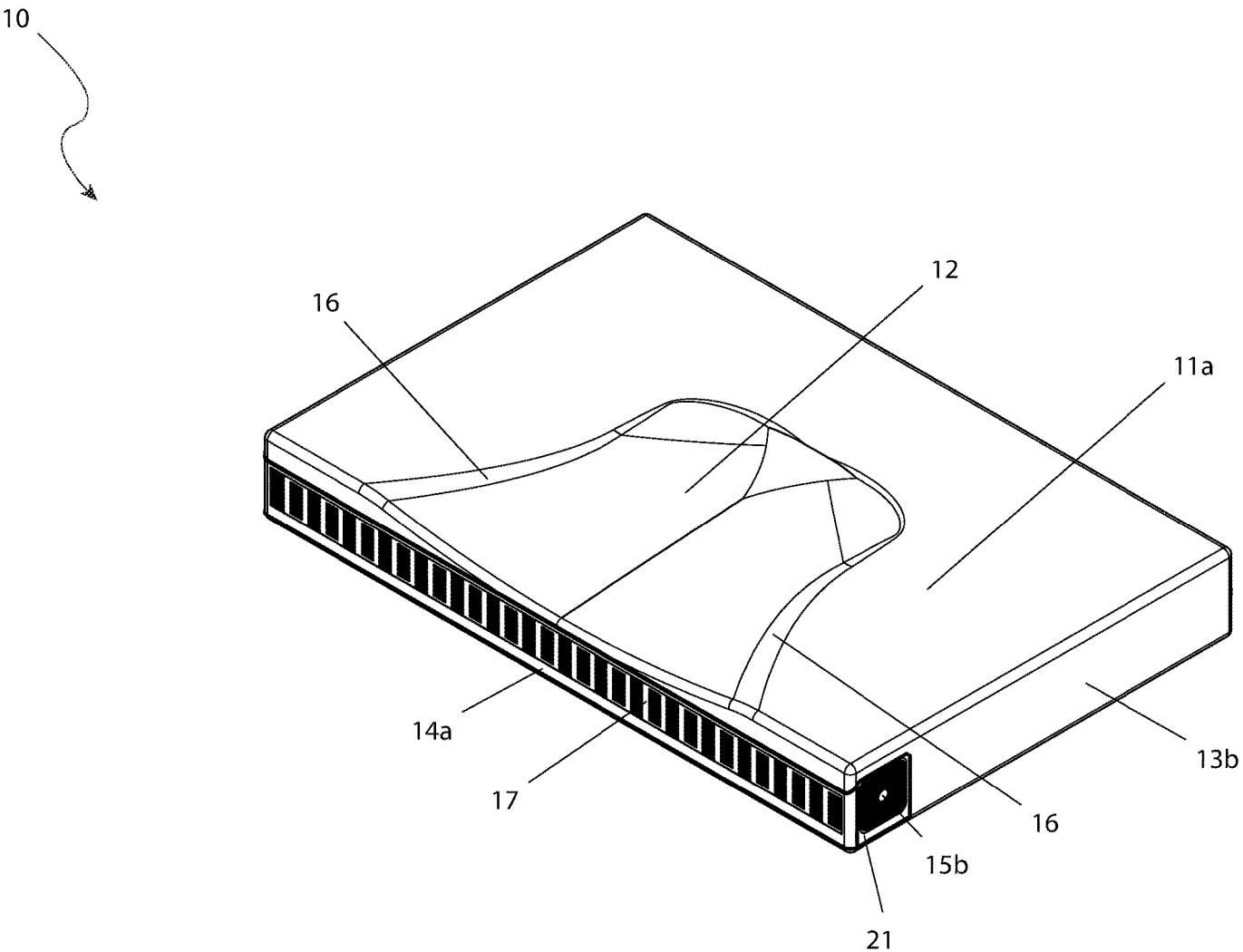
FIG. 1 is a front perspective view of a pillow 10, according to a preferred embodiment of the present device.
Figure 2:
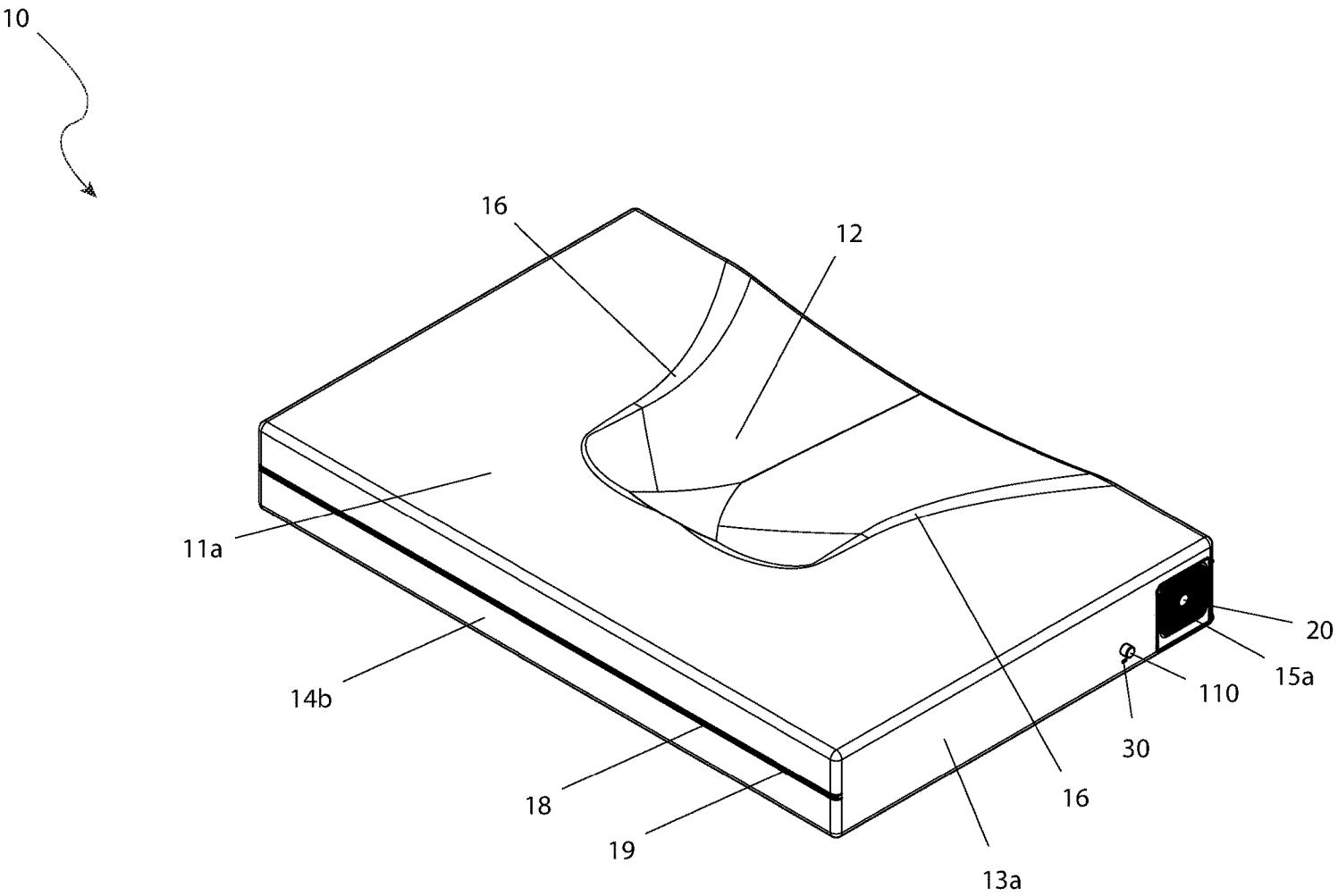
FIG. 2 is a rear perspective view of the pillow 10, according to the preferred embodiment of the present device.
Figure 3:
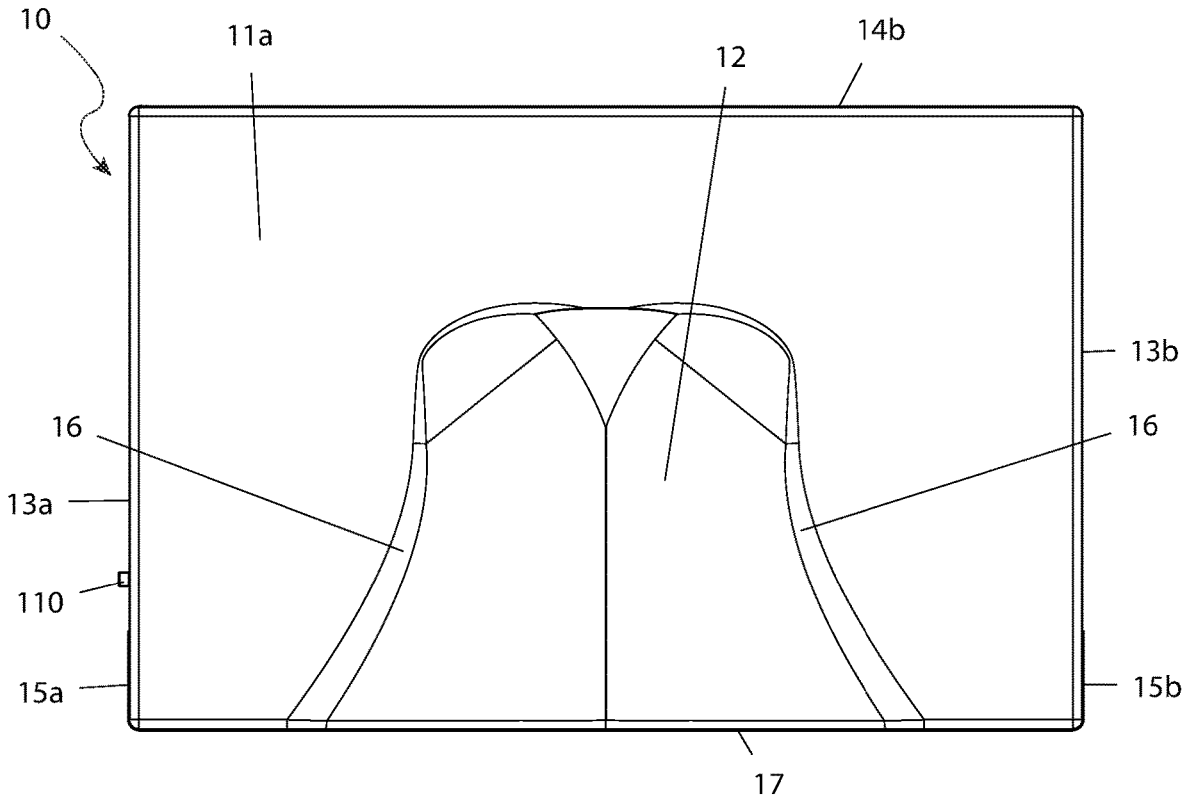
FIG. 3 is a top plan view of the pillow 10, according to a preferred embodiment of the present device.
Figure 4:
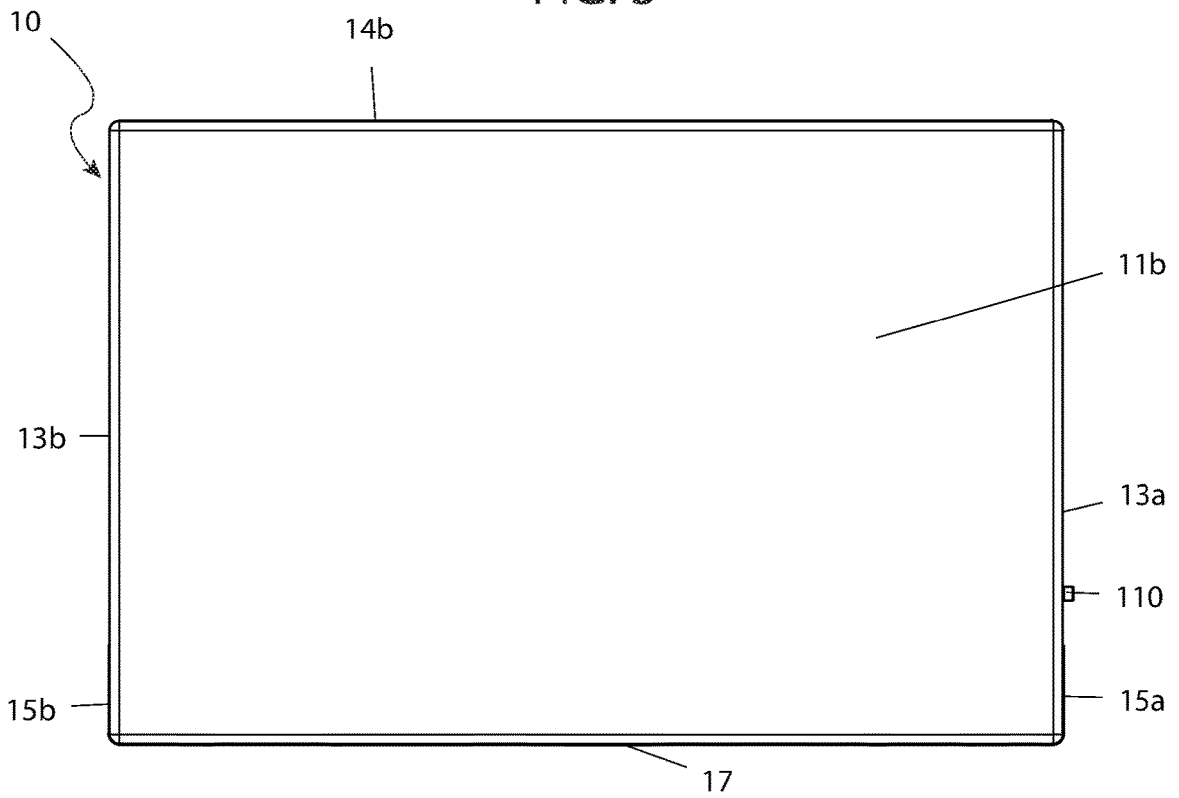
FIG. 4 is a bottom plan view of the pillow 10, according to the preferred embodiment of the present device.
Figure 5:
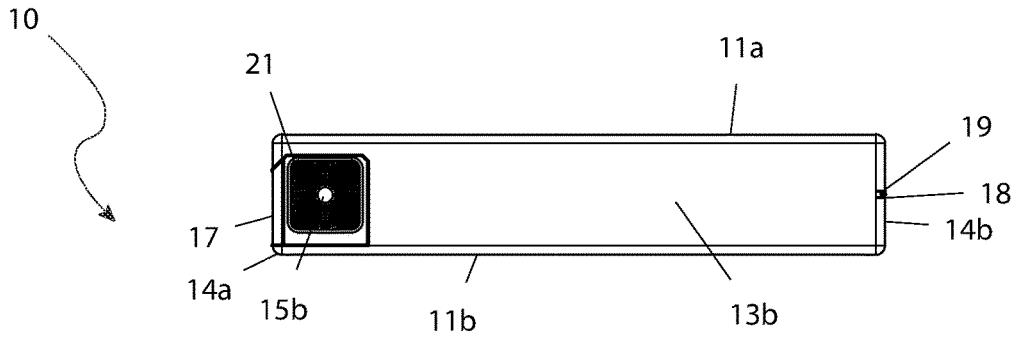
FIG. 5 is a left side elevation view of the pillow 10, according to a preferred embodiment of the present device.
Figure 6:
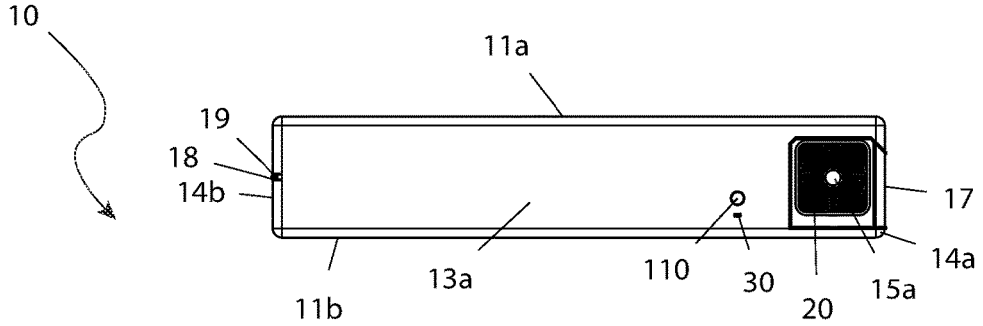
FIG. 6 is a right side elevation view of the pillow 10, according to the preferred embodiment of the present device.
Figure 7:
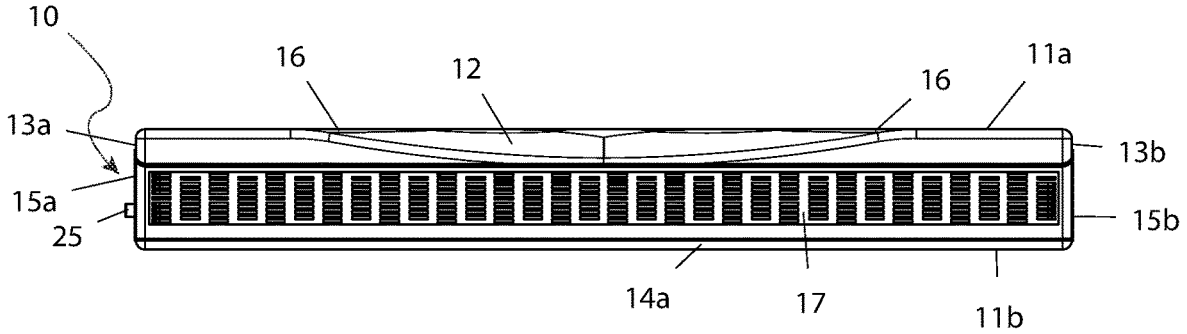
FIG. 7 is a front elevation view of the pillow 10, according to a preferred embodiment of the present device.
Figure 8:
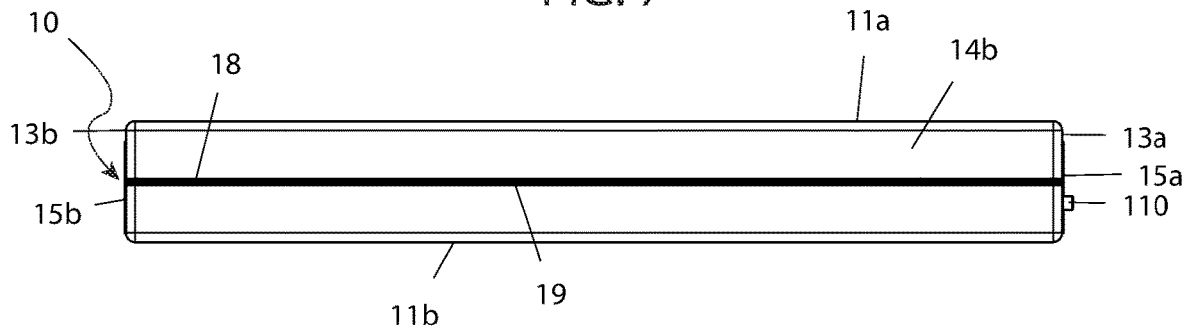
FIG. 8 is a rear elevation view of the pillow 10, according to the preferred embodiment of the present device.

10 pillow
11 top portion
**11*b*** bottom portion
12 contoured section
**13*a*** first side portion
**13*b*** second side portion
**14*a*** front portion
**14*b*** rear
**15*a*** first louver
**15*b*** second louver
16 crease
17 vent
18 opening
19 fastener
20 first blower
21 second blower

30 port
40 user
50 forced air flow
101 power supply/charge controller
105 battery
110 power switch
115 main controller
120 motor drive controller
125 first blower motor
126 second blower motor
130 transceiver

DESCRIPTION OF THE DEVICE

The best mode for carrying out the device is presented in terms of its preferred embodiment, herein depicted within FIGS. 1 through 10. However, the device is not limited to the described embodiment, and a person skilled in the art will appreciate that many other embodiments of the device are possible without deviating from the basic concept of the device and that any such work around will also fall under scope of this device. It is envisioned that other styles and configurations of the present device can be easily incorporated into the teachings of the present device, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

Figure 9:
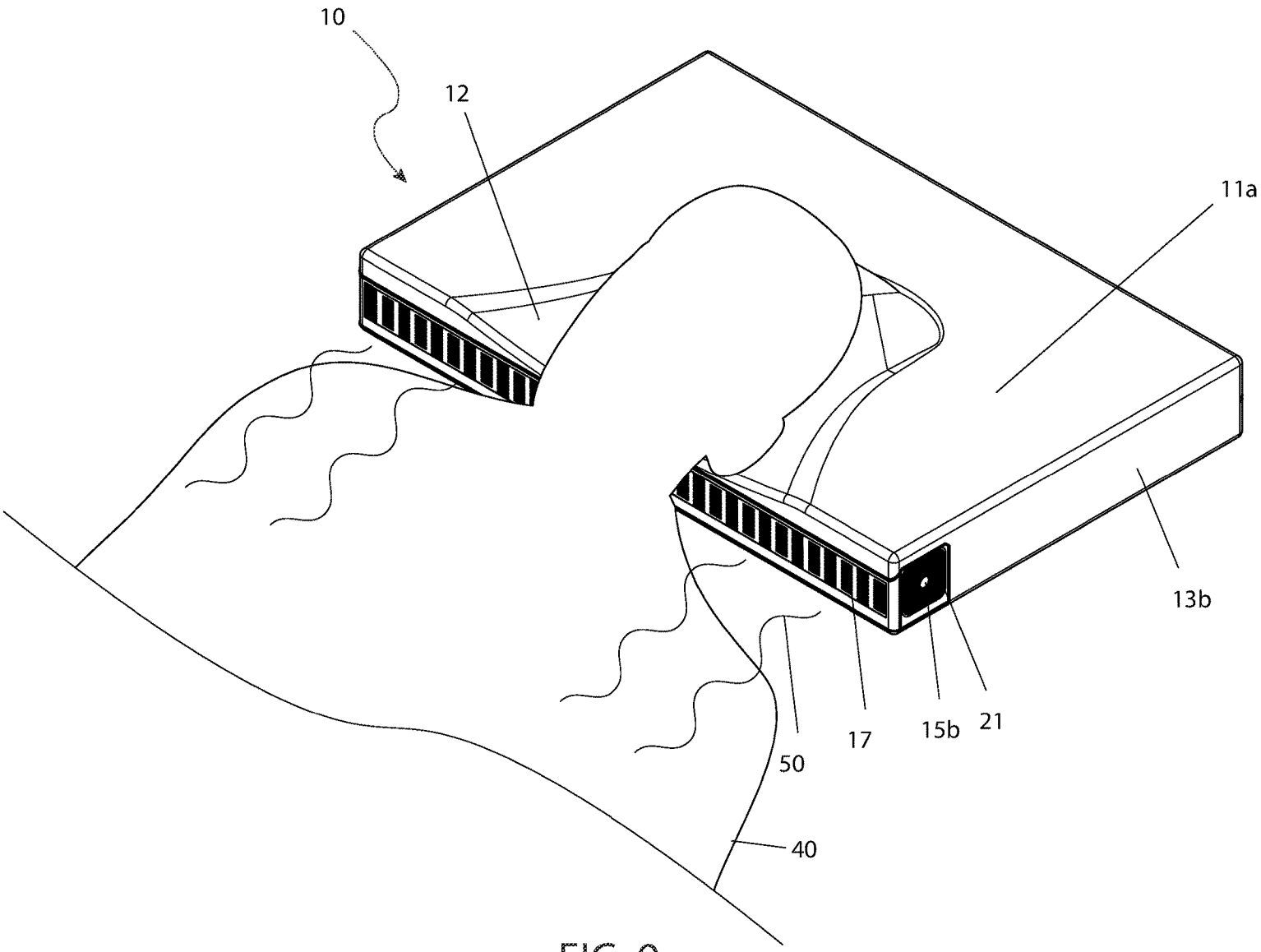
FIG. 9 is an environmental view of a user 40 resting a head on a contoured section 12 of the pillow 10 and in environmental communication with a forced air flow 50, according to a preferred embodiment of the present device; and, FIG. 10 is an electrical schematic of the pillow 10, according to the preferred embodiment of the present device.

The terms "a" and "an" herein do not denote a limitation of quantity, but rather denote the presence of at least one (1) of the referenced items. Referring now to FIG. 9, the pillow 10 is configured to enable a user 40 to rest a portion of their body, typically the head, thereupon and further comprises features that provide a comforting thermal transfer of heat from the environment in order to provide the user 40 and the portion of the body resting thereupon with a cooling forced air flow 50 and to remain cool throughout a desired and selective period of time. The pillow 10 has a contoured section 12 that positions the head of the user 40 in a central location thereon.

Referring now to FIGS. 1-8, the pillow 10 comprises generally a rectangular prism shape with a top portion 11*a*, a bottom portion 11*b*, a first side portion 13*a*, a second side portion 13*b*, a front portion 14*a*, and a rear portion 14*b*. The top portion 11*a* further comprises a tapered and formed contoured section 12 bracketed by a pair of creases 16 that may mimic the head, neck and upper part of the body of a user 40 in a cradle-type manner, although the contoured section 12 may be any desired shape and still provide a similar function. The contoured section 12 is located on the top portion 11 and adjacent to and perhaps transitioning directly into the front portion 14*a*.

Located internal to the pillow 10, and positioned adjacent to the front portion 14*a*, is a conduit. Located at a first end of the conduit, ostensibly adjacent to the first side portion 14*a*, is a first louver portion 15*a*. Located at an opposite second end of the conduit, ostensibly adjacent to the second side portion 14*b*, is a second louver 15*b*. The first louver 15*a* and second louver 15*b* may be fixed to the respective side wall portions 14*a*, 14*b* to provide limited communication between the conduit and the exterior environment, or they may be selectively adjustable. Located within the first end of the conduit is a first blower 20 and located within the second end of the conduit is a second blower 20, each in electrical communication with a power supply/charge controller 101. The first blower 20 and second blower 21 may reside within the conduit or be in environmental communication therewith. In the exemplary embodiment, the first blower 20 is located adjacent the first louver 15*a* such that the intake of the first blower 20 is oriented against the first louver 15*a* and any forced air flow 50 that is generated is directed into the conduit. Similarly, the second blower 21 is located adjacent the second louver 15*b* such that the intake of the second blower 21 is oriented against the second louver 15*b* and any forced air flow 50 that is generated is directed into the conduit. A vent 17 is located on the front portion 14*a* and is in environmental communication with the interior of the conduit. The vent 17 may have a length coextensive with the conduit or a portion thereof and may have a height coextensive with the height of the front portion 14*a*, although other sizes and shapes are envisioned. The vent 17 is also capable of directing a forced air flow 50 away from the pillow 10 and to the environment.

Located on the pillow 10 is a port 30 capable of enabling the power supply/charge controller 101 to be recharged as necessary. A power switch 110 is also located on the pillow 10 and is in electrical communication between the power supply/charge controller 101, the first blower 20, and second blower 21. In the exemplary embodiment, the port 30 and power switch 110 is located on the first side portion 14*a*, adjacent the first louver 15*a*, although other locations are envisioned to fall under the overall scope of the present device. In other embodiments, the power switch 110 may also provide a variable speed adjustment means.

The pillow 10 is preferably constructed of memory foam and provided with a satin cover that is capable of protecting the entire outer profile of the pillow 10 to enable a more comfortable resting place. The first blower 20 and second blower 21 may be small electric fans and the conduit may be a flexible PVC or plastic tubular member that does not interfere or damage the pillow 10 or a user 40 thereof, and resilient enough to withstand normal usage of the pillow 10. The vent 17 may be covered with a mesh or other permeable material to assist in thermal transfer, with or without the cover being placed thereon. The second side portion 14*a* may have an opening 18 to provide access to an interior of the pillow 10, for adding or changing cushioning, accessing any internal features or the conduit, or for placing items therein, A fastener 19 may selectively close the opening 18. Such a fastener 19 may be a zipper.

Figure 10:
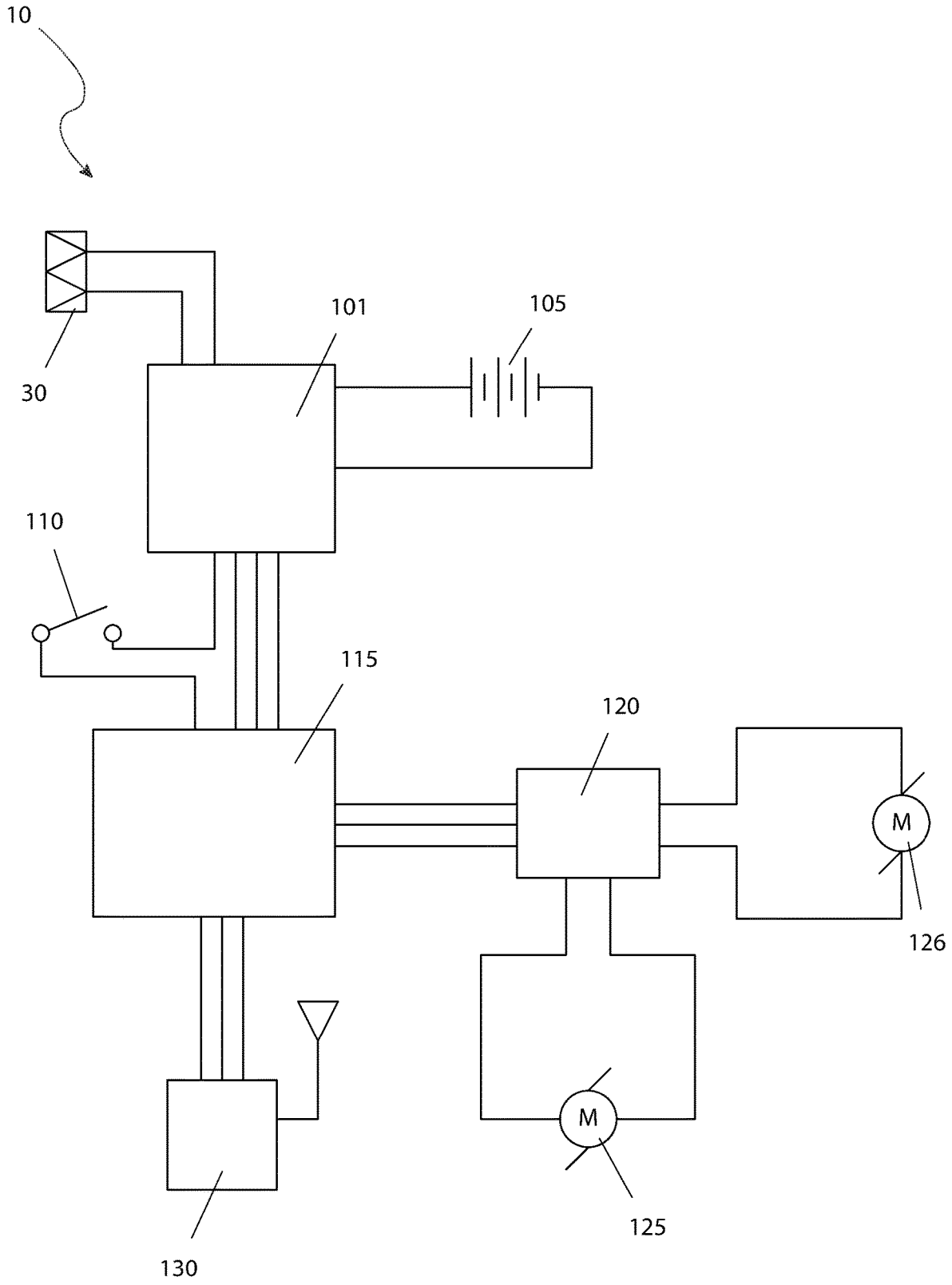

Referring now to FIG. 10, electrical power for the pillow 10 is delivered through the port 30 to a power supply/charge controller 101. Resultant power from the power supply/charge controller 101 is used to charge a battery 105. Similarly, resultant power of the correct voltage and current, is controlled via the power switch 110 and subsequently delivered to a main controller 115. The main controller 115 is envisioned to be a single board computer (SBC) capable of accepting various inputs and outputs as well as processing logic. The main controller 115 provides an output signal to a motor drive controller 120 which allows for variable speed control (if desired) and selective activation of a first blower motor 125 which is in mechanical contact with the first blower 20 and a second blower motor 126 which is in mechanical contact with the second blower 21. The main controller 115 is provided with input/output functionality via a transceiver 130, such as Bluetooth-enabled device. The transceiver 130 is envisioned to pair with personal electronic devices, tablet computers, home automation systems, notebook computers and the like running dedicated control applications. Parameters envisioned to be controlled via the transceiver 130 are on/off control, speed control, timer operation, and similar functionality.

The foregoing descriptions of specific embodiments of the present device have been presented for purposes of illustration and description. They are not intended to be exhaustive or to limit the device to the precise forms disclosed, and obviously many modifications and variations are possible in light of the above teaching. The embodiments were chosen and described in order to best explain the principles of the device and its practical application, to thereby enable others skilled in the art to best utilize the device and various embodiments with various modifications as are suited to the particular use contemplated.

What is claimed is:

1. A pillow comprising:

a pillow body formed of memory foam and having a top portion, a bottom portion, a first side portion, a second side portion, a front portion, and a rear portion;

the top portion including a contoured section positioned to support a user's head;

a vent located on the front portion and in environmental communication with an interior of the pillow body;

a first louver located at the first side portion and a second louver located at the second side portion;

a first blower positioned within the pillow body proximate the first side portion and arranged with an intake facing the first louver;

a second blower positioned within the pillow body proximate the second side portion and arranged with an intake facing the second louver;

a power supply/charge controller electrically coupled to a battery and to a power switch;

a main controller operatively coupled to a transceiver and configured to receive wireless commands;

a motor drive controller operatively coupled to the main controller and to a first blower motor mechanically coupled to the first blower and to a second blower motor mechanically coupled to the second blower;

wherein the motor drive controller is configured to vary rotational speed of the first blower motor and the second blower motor in response to control signals from the main controller;

wherein the power switch is configured to enable and disable electrical power delivery from the power supply/charge controller to the first blower and the second blower; and, wherein, when at least one of the first blower and the second blower is energized, ambient air is drawn through at least one of the first louver and the second louver and is directed through the interior of the pillow body and out of the vent on the front portion.

2. The pillow of claim 1, wherein:

the transceiver comprises a Bluetooth transceiver operatively coupled to the main controller and configured to receive wireless commands to set on/off state, blower speed, and timer operation;

the main controller comprises a single board computer;

the top portion includes two creases at predetermined locations on opposite sides of the contoured section, the creases being configured to conform to a natural curvature of a user's head and neck;

the second side portion includes an opening providing access to the interior of the pillow body, and a fastener configured to selectively close the opening, the fastener comprising a zipper;

the pillow body is covered by a satin cover;

the vent is covered by a mesh or other permeable material; and, the first side portion includes a charging port electrically coupled to the power supply/charge controller and the power switch located adjacent the charging port.

* * * * *